US007371714B2

(12) United States Patent
Johnston et al.

(10) Patent No.: US 7,371,714 B2
(45) Date of Patent: May 13, 2008

(54) CHEMICAL AGENT DECONTAMINATION COMPOSITION COMPRISING A PERFLUORINATED ALKYL BROMIDE

(75) Inventors: David S. Johnston, Gunpowder, MD (US); Gennady E. Platoff, Millersville, MD (US); Steven I. Baskin, Bel Air, MD (US); Thomas P. Logan, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 98 days.

(21) Appl. No.: 11/472,434

(22) Filed: Jun. 22, 2006

(65) Prior Publication Data

US 2008/0085848 A1 Apr. 10, 2008

Related U.S. Application Data

(60) Provisional application No. 60/693,093, filed on Jun. 23, 2005.

(51) Int. Cl.
*C11D 3/24* (2006.01)
*C11D 3/395* (2006.01)

(52) U.S. Cl. ..... 510/110; 510/273; 510/375; 510/204

(58) Field of Classification Search ..... 510/110, 510/273, 375, 204
See application file for complete search history.

(56) References Cited

U.S. PATENT DOCUMENTS

| | | | | |
|---|---|---|---|---|
| 4,183,962 | A * | 1/1980 | Asher | 514/771 |
| 4,490,351 | A * | 12/1984 | Clark, Jr. | 424/9.4 |
| 4,742,050 | A * | 5/1988 | Yuhas et al. | 514/34 |
| 5,655,521 | A * | 8/1997 | Faithfull et al. | 128/203.12 |
| 6,204,296 | B1 * | 3/2001 | Weers et al. | 514/757 |
| 2001/0048094 | A1 * | 12/2001 | Hagen et al. | 252/3 |

* cited by examiner

*Primary Examiner*—Charles Boyer
(74) *Attorney, Agent, or Firm*—Elizabeth Arwine

(57) ABSTRACT

A composition and methods of use for the decontamination of chemical agents, including chemical warfare agents. The decontamination composition is nontoxic, nonflammable and non-corrosive and includes an effective amount of a perfluorinated alkyl bromide or reactive perfluorinated alkyl bromide. The decontamination composition may include an oxidizer and a solvent.

14 Claims, No Drawings

CHEMICAL AGENT DECONTAMINATION COMPOSITION COMPRISING A PERFLUORINATED ALKYL BROMIDE

I. CROSS-REFERENCE TO RELATED APPLICATIONS

This application claims the benefit under 35 U.S.C. 119(e) of U.S. Provisional Application No. 60/693,093, filed Jun. 23, 2005, which is hereby incorporated by reference in its entirety.

II. FIELD OF THE INVENTION

The present invention relates to the field of compositions useful in the decontamination of material, equipment and personnel exposed to chemical agents. More particularly, the present invention relates to compositions used for the decontamination of chemical warfare agents, such as pinacolyl methylphosphonofluoridate, also known as GD. The present invention has particular applicability to combating terrorism by providing a decontamination solution useful to treating mass casualties and areas in the event of a terrorist WMD chemical attack.

III. BACKGROUND OF THE INVENTION

Exposure to toxic agents, and especially chemical warfare agents and related toxins, is a potential hazard to the armed forces and to civilian populations. Chemical warfare agents are stockpiled by several nations, and other nations and terrorist groups actively seek to acquire these materials. Some commonly known chemical warfare agents are bis-(2-chloroethyl)sulfide, also known as HD or mustard gas, pinacolyl methylphosphonofluoridate, which is also known as Soman or GD, and O-ethyl S-(2-diisopropylamino)ethyl methylphosphonothiolate, known as VX. Both HD and GD are also known to be available in both neat and thickened forms. As will be appreciated, it is essential to have agents which can rapidly decontaminate surfaces which have come into contact with these chemical warfare agents, not only in battlefield situations, but also in today's climate of terrorist threats of WMD chemical attacks.

Methods for decontamination of chemical agents, which include a variety of organophosphorous and organosulfur compounds, are known in the art. However, these known methods use compositions that have many drawbacks and undesirable properties, such as corrosiveness, flammability and toxicity. For example, hypochlorite formulations are very corrosive and toxic. These solutions are not optimal for use in treating civilians or like populations that do not have protective clothing or training in decontaminating themselves and equipment with such solutions. Additionally, many decontamination agents degrade upon exposure to water and carbon dioxide, requiring that these solutions be prepared and used the same day they are needed. Such solutions are not particularly suited for surprise situations such as terrorist attacks. Local fire departments cannot stockpile these types of solutions for use in a future unknown and unsuspected terrorist attack. Additional drawbacks with prior art decontamination agents include things such as the need for substantial scrubbing for removal and destruction of a chemical warfare agents when using decontaminates such as hypochlorite solutions. The provision of personnel and training to aid civilians in proper scrubbing when using these decontaminants is currently not feasible.

The foregoing underscores some of the problems associated with convention decontamination agents and their role in the fight against terrorism. Furthermore, the foregoing highlights the need for a stable composition which can effectively decontaminate chemical agents without the undesirable properties or excessive scrubbing described above.

IV. SUMMARY OF THE INVENTION

Various embodiments of the present invention overcome the practical problems described above and offer additional advantages as well. Some of the embodiments of the present invention solves the above-described drawbacks by providing nontoxic chemical agent decontamination compositions.

The present invention relates to the use of perfluorinated alkyl bromides (PFABs) and reactive perfluorinated alkyl bromides (rPFABs) as a chemical warfare/terrorism WMD agent decontamination formula for application to solid, porous and fibrous surfaces including, but not limited to, skin, wounds, equipment, clothing, carpets and electronics. rPFAB is defined as the combination of PFAB with reactive moieties and formulating agents, such as but not limited to, pralidoxime chloride (2-PAM-CI), 1-2-hydroxy-iminomethyl-1-pyridino-3-(4-carbamoyl-1-pyridino-2-oxapropane dichloride (HI-6), polyamines, metals, metal oxides and perfluorinated surfactants, with the intent to enhance the decontamination properties of the formula.

According to one aspect of the invention there is provided a composition including an effective amount of a perfluorinated alkyl bromide. According to this aspect of the invention, the perfluorinated alkyl bromide is preferably present in the composition in an amount between about 10% and 100% by weight. According to one feature of the invention the perfluorinated alkyl bromide is 1-bromoperfluorooctane. According to another advantageous feature of the invention, the decontamination solution is a commercially available perfluorinated alkyl bromide such as 1-bromoperfluoroctane.

According to another aspect of the invention there is provided a composition including an effective amount of a reactive perfluorinated alkyl bromide. According to this aspect of the invention, the reactive perfluorinated alkyl bromide is preferably present in the composition in an amount between about 10% and 100% by weight.

According to another aspect of various embodiments of the invention, the composition of the present invention preferably has a pH between about 8 and about 12. According to another aspect of various embodiments of the present invention, the decontamination composition may include an oxidizer and solvent. According to other embodiments of the invention, the composition may include Although the present invention may be adapted for decontamination of a variety of substances in a variety of fields, the present invention is particularly suitable for the decontamination of chemical warfare agents, including pinacolyl methylphosphonofluoridate, bis-(2-chloroethyl)sulfide, and O-ethyl S-(2-diisopropylamino)ethyl methylphosphonothiolate.

The present invention is also related to methods for decontaminating a target contaminated with a chemical agent. According to one aspect of some embodiments of the invention, the method includes applying to a contaminated surface a composition including an effective amount of a perfluorinated alkyl bromide. According to this aspect of the invention, the composition preferably includes between about 1% and about 100% by weight of a perfluorinated alkyl bromide. According to an advantageous feature of the invention, the perfluorinated alkyl bromide may be 1-bromoperfluorooctane. According to another aspect of various embodiments of the invention, the perfluorinated alkyl bromide is 1-bromoperfluoroctane and the composition has a pH between about 8 and about 12.

According to another aspect of other embodiments of the present invention, the method includes applying to a contaminated surface a composition including an effective amount of a reactive perfluoinated alkly bromide. According to this aspect of the invention, the composition preferably includes between about 1% and about 100% by weight of a reactive perfluorinated alkyl bromide.

In alternate methods of other embodiments of the present invention, the method includes adding an oxidizer and/or solvent to the decontamination fluid prior to treating a target.

Various methods and compositions of the present invention are particularly effective in the decontamination of chemical warfare agents, including but not limited to pinacolyl methylphosphonofluoridate, bis-(2-chloroethyl)sulfide, and O-ethyl S-(2-diisopropylamino)ethyl methylphosphonothiolate.

Other objects, features and advantages of this invention will become apparent upon reading the following detailed description in conjunction with the claims.

V. DETAILED DESCRIPTION

The present invention provides novel decontamination fluids and methods for combating terrorism and chemical warfare. According to some embodiments of the present invention there is contemplated the use of perfluorinated alkyl bromides (PFABs) and reactive perfluorinated alkyl bromides (rPFABs) as a chemical warfare/terrorism agent decontamination formula for application to solid, porous and fibrous surfaces including, but not limited to, skin, wounds, equipment, clothing, carpets and electronics. rPFAB is understood in the art as the combination of PFAB with reactive moieties and formulating agents, such as but not limited to, pralidoxime chloride (2-PAM-CI), 1-2-hydroxyiminomethyl-1-pyridino-3-(4-carbamoyl-1-pyridino-2-oxapropane dichloride (HI-6), polyamines, metals, metal oxides and perfluorinated surfactants, with the intent to enhance the decontamination properties of the formula.

There are many advantages to using PFABs and rPFABs in chemical decontamination applications. PFABs are known to have extremely low toxicity and have already received FDA approval for various uses in humans including large oral doses. PFABs have excellent stability characteristics and will remain effective during long periods of storage or under extreme conditions, unlike other substances commonly used which must be mixed just prior to application. Again, the infeasibility of using such solutions in civilian areas limits their effectiveness in the war against terror. PFABs also provide a unique hydrophobic environment to solubilize organic reactive moieties to assist in decontamination. In addition, PFABs are non-ozone depleting and can be used in large quantities without fear of environmental contamination.

The compositions of the present invention are effective in the decontamination of chemical warfare agents, including but not limited to pinacolyl methylphosphonofluoridate, bis-(2-chloroethyl)sulfide, and O-ethyl S-(2-diisopropylamino)ethyl methylphosphonothiolate. One of ordinary skill in the art armed with the present specification will readily appreciate that the effectiveness of the compositions of the present invention in decontaminating any given agent at any given concentration is a matter of routine experimentation well within the ability of the skilled artisan.

According to a presently preferred embodiment, there is provided a chemical agent decontamination composition including an effective amount of a perfluorinated alkyl bromide. Preferably, the composition includes between about 1% and about 100% by weight of a perfluorinated alkyl bromide.

Various PFABs may be used in the composition of the present invention, including, but not limited to 1-bromoperfluorooctane. In alternate embodiments of the invention, the PFAB used in the composition may be an rPFAB.

In some embodiments of the invention, a nontoxic solvent is present in the decontamination composition. Preferably, the solvent is also non-flammable and non-corrosive. Such properties lend the solution to use with civilian or untrained populations in mass casualty situations under difficult conditions with less risk of exacerbating the situation. The exact solvent and concentration of solvent is based on the desired properties of the composition and its intended use. The choice of suitable solvents and concentrations is well within the ability of the ordinarily skilled artisan. A presently preferred solvent is water. Water is non-flammable and non-toxic, provides its own intrinsic rinsing, easily accessible, may be used in large quantities, and is not believed to overly interfere with the unique hydrophobic environment of PFABs.

Some compositions of the present invention also include an oxidizer. Suitable oxidizers for use in the present invention include but are not limited to, hydrogen peroxide and other peroxy or hydroperoxy compounds such as the acids and salts of peracetate, perborate monohydrate, perborate tetrahydrate, monoperoxyphthalate, peroxymonosulfate, peroxydisulfate, and percarbonate. A presently preferred oxidizer is hydrogen peroxide. The role of hydrogen peroxide in decontaminating fluids is known in the art and the exact concentration to use and its effectiveness may be determined through routine experimentation. The inclusion of an activatable species, such as a source of hydroxyl ions for subsequent activation, adds to the universality of the composition for decontamination purposes in emergency circumstances. Hydrogen peroxide is presently preferred as a precursor species that produces hydroxyl ions. Hydrogen peroxide is effective in rapidly destroying many types of biological microorganisms, is an aqueous solution, decomposes ultimately to oxygen and water, leaves no chemical residue after decomposition, is nontoxic to humans and animals, and is inexpensive and readily available in large quantities.

Decontamination compositions according to another aspect of the invention may optionally include a corrosion inhibitor. Suitable corrosion inhibitors include, but are not limited to isobutanolamine, also known as 2-amino-2-methyl-1-propanol. One of skill in the art may substitute other non-toxic corrosion inhibitors, which may be selected from amino alcohols, amines and polyamines. The corrosion inhibitor may be incorporated in the composition of the present invention in any suitable amount, as determinable by those having skill in the art based on the desired properties of the decontamination fluid and its intended role in the decontamination process.

Decontamination compositions according to another aspect of the invention may optionally include additives such as preservatives, buffers and reaction catalysts. Again the use of such materials and their role in decontamination fluids are known in the art. The proper selection of additives may be determined by those of ordinary skill in the art based on the desired properties of the decontamination fluid and its intended storage life, other additives already in the fluid, and the intended role of the fluid in the decontamination process.

The decontamination composition preferably has a pH between about 8 and about 12. This pH range may allow the fluid to act as a mild base detergent and/or surfactant that aids the removal of chemical agents from surfaces. This pH range is also safe to use on human tissue. If necessary, suitable acids for lowering the pH and bases for raising the pH may be used to adjust the pH to one suitable for the intended purpose of the solution by those having skill in the art.

The composition of the present invention may also include a stabilizer. Any stabilizer known to those having skill in the art which is capable of preventing reaction of the oxidizer with the other components of the composition without inhibiting the ability of the PFAB to neutralize the chemical agent may be used. The selection of a suitable stabilizer is well within the ability of one of ordinary skill in the art and may be selected on the basis of the constituent components of the decontamination solution.

The present invention also relates to a method for decontaminating a chemical agent including the step of applying to a contaminated surface one of the compositions of the present invention as described herein. The method of the present invention may be used to decontaminate solid, porous and fibrous surfaces including, but not limited to, skin, wounds, equipment, clothing, carpets and electronics.

The decontamination composition may be applied by any suitable means known to those having skill in the art which will provide effective decontamination of a particular area, material, equipment, personnel, or the like. For example, the decontamination composition may be applied via spray, shower, hose, atomized spray nozzle, fire hose, etc. The exact choice of delivery is not essential to the methods of the present invention.

The methods of the present invention are effective in the decontamination of chemical warfare agents, including but not limited to pinacolyl methylphosphonofluoridate, bis-(2-chloroethyl)sulfide, and O-ethyl S-(2-diisopropylamino) ethyl methylphosphonothiolate. One of ordinary skill in the art armed with the present specification will readily appreciate that the effectiveness of the methods of the present invention in decontaminating any given agent at any given concentration is a matter of routine experimentation well within the ability of the skilled artisan.

This invention is further illustrated by the following examples, which are not intended to be construed in limitating the scope of the invention to the precise formulations and scope described therein.

EXAMPLE 1

Guinea pigs had their fur clipped off one side, were weighed and then sorted into groups. The animals were sedated and placed inside of a chemical hood. Eight ml of 1-Bromoperfluorooctane (compound #3881) was placed into a 50 ml centrifuge tube. A four ply, 5 cm by 7.5 cm gauze pad (70% viscose, 30% polyester) was placed into the 1-Bromoperfluorooctane in the tube. GD was placed on the clipped side of the sedated animal and one minute later the gauze soaked in 1-Bromoperfluorooctane was wiped across the animal with sufficient pressure to depress the rib cage of the animal. This wet gauze pad was wiped across the animal (in the direction of the fur) one time and then rotated to the clean side and wiped in the same direction across the animal three times. A second dry piece of gauze was then used to wipe the area in an identical manner. The animals were placed in cages inside the chemical hood and their vital signs were recorded. After 24 hours it was recorded which animals lived and which died. Euthanasia was carried out on remaining animals and all bodies were decontaminated using excess bleach. The results are displayed below in Table 1.

TABLE 1

1st $LD_{50}$ of 1-Bromoperfluorooctane Compound #3881 vs. GD

| Animal No. | Exposure Solution/ Time | Dose of #3881 Given | Onset of Signs | Onset of Seizure | Disposition |
|---|---|---|---|---|---|
| 2044 | A/1344 | 33.9 mg/kg | 1357 | NS | Euthanasia @ 24 hrs |
| 2045 | B/1349 | 67.8 mg/kg | 1404 | NS | Euthanasia @ 24 hrs |
| 2046 | B/1354 | 67.8 mg/kg | 1404 | NS | Dead @ 1435 |
| 2047 | C/1359 | 101.7 mg/kg | 1404 | NS | Dead @ 1507 |
| 2048 | F/1404 | 24.5 mg/kg | 1406 | NS | Euthanasia @ 24 hrs |
| 2049 | D/1409 | 135.6 mg/kg | 1414 | NS | Dead @ 1436 |
| 2050 | A/1414 | 33.9 mg/kg | 1431 | NS | Euthanasia @ 24 hrs |
| 2051 | C/1419 | 101.6 mg/kg | 1427 | NS | Dead > 1700 |

| Solution/ Volume of #3881 Used | Dose of #3881 Given | Avg. animal weight |
|---|---|---|
| F/7.0 μL | 24.5 mg/kg | 286 g |
| A/9.8 μL | 33.9 mg/kg | 290 g |
| B/19.5 μL | 67.8 mg/kg | 287 g |
| C/28.6 μL | 101.7 mg/kg | 281 g |
| C/30.6 μL | 101.6 mg/kg | 301 g |
| D/43.5 μL | 135.6 mg/kg | 321 g |

The onset of signs observed for each animal after the exposure solution had been administered included the following: 2044—labored breathing, 2045, 2046 and 2047—cyanosis, 2048—tremors, 2049, 2050 and 2051—local fasciculations.

EXAMPLE 2

The procedure of Example 1 was followed, except for the following modifications. The first gauze pad was withdrawn from the centrifuge tube, wiped one time across the animal and then the remaining 1-Bromoperfluorooctane in the tube (approximately 4 ml) was poured onto the exposure site. This made sure that all 8 ml was used in the decontamination. Decontamination with the first gauze pad continued with three more wipes across the animal. The results are detailed below in Table 2.

TABLE 2

$2^{nd}$ $LD_{50}$ of 1-Bromoperfluorooctane Compound # 3881 (full 8 ml applied) vs. GD

| No. | Exposure Solution/ Time | Dose of #3881 Given | Onset of Signs | Onset of Seizure | Disposition |
|---|---|---|---|---|---|
| 2060 | C/0958 | 124.3 mg/kg | 1055 | NS | Euthanasia @ 24 hrs |
| 2061 | B/1003 | 90.4 mg/kg | 1020 | NS | Euthanasia @ 24 hrs |
| 2062 | A/1008 | 56.5 mg/kg | 1026 | NS | Euthanasia @ 24 hrs |
| 2063 | A/1013 | 56.5 mg/kg | 1023 | NS | Euthanasia @ 24 hrs |
| 2064 | B/1018 | 90.4 mg/kg | 1034 | NS | Dead @ 1051 |
| 2065 | C/1023 | 124.3 mg/kg | 1032 | NS | Euthanasia @ |

TABLE 2-continued

| 2nd $LD_{50}$ of 1-Bromoperfluorooctane Compound # 3881 (full 8 ml applied) vs. GD | | | | | |
|---|---|---|---|---|---|
| 2066 | A/1028 | 56.5 mg/kg | 1029 | NS | 24 hrs Euthanasia @ 24 hrs |
| 2067 | D/1033 | 146.9 mg/kg | 1039 | NS | Dead > 1700 |

| Solution/ Volume of #3881 Used | Dose of #3881 Given | Avg. animal weight |
|---|---|---|
| A/17.7 μL | 56.5 mg/kg | 313 g |
| B/31.6 μL | 90.4 mg/kg | 350 g |
| C/42.1 μL | 124.3 mg/kg | 339 g |
| D/46.6 μL | 146.9 mg/kg | 317 g |

The effectiveness of drugs and decontamination techniques may be determined by measuring the Mean Lethal Dose (MLD), in untreated animals and treated animals. The MLD is the dose of a drug or composition in which half of the animals given the drug or composition will expire. A protective ratio is determined by dividing the MLD for the treated animals by the MLD for the untreated animals. The protective ratio can then be used to determine the effectiveness of a given drug or composition.

As indicated in the above studies, the $LD_{50}$ resulting from Example 1 appears to be 67.8 mg/kg which is a protective ratio of approximately 6 (see Table 1). After modifications were made to the method (see Example 2) the $LD_{50}$ appears to be 124.3 mg/kg which is a protective ratio of approximately 11, as indicated in Table 2. However, there was one outlier in the B group. Nonetheless, the results of Example 2 clearly indicate that the application of a solution comprising a perfluorinated alkyl bromide is an effective method of decontaminating surfaces exposed to chemical warfare substances such as GD.

Although only a few exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

One of ordinary skill in the art armed with the teaching and examples of the present application can determine an effective amount for the compositions of the present invention for a given chemical agent.

What is claimed is:

1. A method for decontaminating a chemical agent selected from the group consisting of pinacolyl methylphosphonofluoridate, bis-(2-chloroethyl)sulfide, or O-ethyl S-(2-diisopropylamino)ethyl methylphosphonothiolate, comprising the step of:

applying to a contaminated surface a composition comprising an effective amount of a perfluorinated alkyl bromide.

2. The method of claim 1, wherein the composition comprises between about 1% and about 100% by weight of a perfluorinated alkyl bromide.

3. The method of claim 2, wherein the composition comprises between about 75% and about 90% by weight of a perfluorinated alkyl bromide.

4. The method of claim 1, wherein the perfluorinated alkyl bromide is 1-bromoperfluorooctane.

5. The method of claim 1, wherein the perfluorinated alkyl bromide is a reactive perfluorinated alkyl bromide.

6. The method of claim 1, wherein the composition further comprises a non-toxic solvent.

7. The method of claim 6, wherein the composition further comprises an oxidizer.

8. The method of claim 7, wherein the oxidizer is selected from the group consisting of hydrogen peroxide and the acids or salts of peracetate, perborate monohydrate, perborate tetrahydrate, monoperoxyphthalate, peroxymonosulfate, peroxydisulfate and percabonate.

9. The method of claim 8, wherein the oxidizer is hydrogen peroxide.

10. The method of claim 6, wherein the solvent is water.

11. The method of claim 1, wherein the composition further comprises a corrosion inhibitor.

12. The method of claim 11, wherein the corrosion inhibitor is selected from the group consisting of an amino alcohol, an amine or a polyamine.

13. The method of claim 1, wherein the composition further comprises a buffer, a stabilizer, a reaction catalyst, or a preservative.

14. The method of claim 1, wherein the pH of the composition is between about 8 and about 12.

* * * * *